US011801548B2

(12) United States Patent
Ullrich et al.

(10) Patent No.: US 11,801,548 B2
(45) **Date of Patent: *Oct. 31, 2023**

(54) FENCE MESH FORMING MACHINE

(71) Applicant: Ullrich Machinery Company Limited, Christchurch (NZ)

(72) Inventors: Mark William Ullrich, Christchurch (NZ); Owen Joris Meijer, Loburn (NZ)

(73) Assignee: UMC INNOVATION LIMITED

( * ) Notice: Subject to any disclaimer, the term of this patent is extended or adjusted under 35 U.S.C. 154(b) by 0 days.

This patent is subject to a terminal disclaimer.

(21) Appl. No.: 17/046,901

(22) PCT Filed: Apr. 12, 2019

(86) PCT No.: PCT/IB2019/053015

§ 371 (c)(1),
(2) Date: Oct. 12, 2020

(87) PCT Pub. No.: WO2019/198038

PCT Pub. Date: Oct. 17, 2019

(65) Prior Publication Data

US 2021/0146425 A1 May 20, 2021

(30) Foreign Application Priority Data

Apr. 12, 2018 (NZ) ..... 741592

(51) Int. Cl.

| | |
|---|---|
| ***B21F 27/08*** | (2006.01) |
| ***B21F 15/06*** | (2006.01) |
| *E04H 17/02* | (2006.01) |

(52) U.S. Cl.
CPC ..... *B21F 27/08* (2013.01); *B21F 15/06* (2013.01); *E04H 17/02* (2013.01)

(58) Field of Classification Search
CPC ..... B21F 27/00; B21F 27/08; B21F 15/02; B21F 15/06; E04H 17/02
See application file for complete search history.

(56) References Cited

U.S. PATENT DOCUMENTS 778,844 A * 1/1905 Bugee et al. ..... B21F 27/08 140/116
1,873,461 A 8/1932 Nigro et al.
(Continued)

FOREIGN PATENT DOCUMENTS

NZ 517885 A 11/2003
NZ 519253 A 1/2004
(Continued)

OTHER PUBLICATIONS

International Search Report and Written Opinion issued in related International Application No. PCT/IB2019/053015 dated May 24, 2019, 8 pages.

*Primary Examiner* — Teresa M Ekiert
(74) *Attorney, Agent, or Firm* — Galbreath Law Offices, P.C.; John A. Galbreath

(57) ABSTRACT

A machine for making a knotted wire fence, including a machine frame, at least one knot box, at least one drive shaft, and a drive shaft driving means, wherein the machine can be switched between a first configuration in which the machine can be used to produce a knotted wire fence incorporating a first knot type, and a second configuration in which the machine can be used to produce a knotted wire fence incorporating a second knot type.

15 Claims, 13 Drawing Sheets

(56) References Cited

U.S. PATENT DOCUMENTS

| | | | | |
|---|---|---|---|---|
| 4,372,588 | A * | 2/1983 | Vansteelant | A01F 15/145 289/8 |
| 6,668,869 | B2 | 12/2003 | Richardson | |
| 6,715,512 | B2 | 4/2004 | Richardson | |
| 2003/0221742 | A1 | 12/2003 | Richardson | |

FOREIGN PATENT DOCUMENTS

| | | | |
|---|---|---|---|
| NZ | 536059 | A | 1/2007 |
| NZ | 536060 | A | 1/2007 |
| NZ | 576685 | A1 | 11/2010 |
| WO | 2010126384 | A1 | 11/2010 |
| WO | 2019198038 | A1 | 10/2019 |

* cited by examiner

FENCE MESH FORMING MACHINE

CROSS-REFERENCE TO RELATED APPLICATIONS

This application is a U.S. National Stage of International Patent Application No. PCT/IB2019/053015, filed 12 Apr. 2019, which claims priority to New Zeland Patent Application No. 741592, filed on 12 Apr. 2018. The disclosure of each application which is incorporated herein by reference in their entirety.

TECHNICAL FIELD

The present invention relates to a machine for producing knotted wire fencing.

BACKGROUND

Any discussion of the prior art throughout the specification is not an admission that such prior art is widely known or forms part of the common general knowledge in the field.

Knotted fence meshes are known, in which a number of parallel line wires extend generally horizontally between a series of supporting fence posts, forming a substantially rectangular lattice with a series of generally vertical stay wires, and at each intersection of a line wire with a stay wire, a third section of wire is twisted around the vertical and horizontal wires in a knot, to hold them together.

Knotted fences are used in applications such as stock fence, game fence, security and construction. An end user may choose from different types of fence mesh according to the particular characteristics most suitable for their application.

One type of known fence knot, shown in FIGS. 12*a* and 12*b* and hereinafter referred to as a "stay knot" 601, is also variously and interchangeably known as "X knot", "stiff stay", "stay lock", "horse fence", "stay lokk", "X fence", or "square deal knot".

Another type of known fence knot, shown in FIG. 13 and hereinafter referred to as "fixed knot" 701, is also variously and interchangeably known as "fixed lock", "solid lock", "fixed lokk", "tight lock", "solid lock", or "stay tight".

These knotted fence meshes are typically made by specialised machines. A series of parallel line wires are fed into a bed of the machine, and a stay wire is fed into the machine across the line wires. A knot box, fed with a knot wire, is located adjacent the stay wire over each line wire. The knot boxes are each driven to bind the knot wire about an intersection between the stay wire and a line wire. Twister boxes on each side on the machine twist the ends of the stay wire about the outer-most line wires. The machine then feeds the line wires on, and repeats the process multiple times, to produce a rectangular mesh.

It is an object of the present invention to provide a machine which can be configured to produce a stay knotted fence, and/or a machine which can be configured to produce a fixed knotted fence, and/or a machine that can be configured to produce at least two different types of knotted fence, and/or to provide the public with a useful choice.

DISCLOSURE OF INVENTION

Therefore the present invention provides a machine for making a knotted wire fence, including a machine frame, at least one knot box, at least one drive shaft, and a drive shaft driving means, wherein the machine can be switched between a first configuration in which the machine can be used to produce a knotted wire fence incorporating a first knot type, and a second configuration in which the machine can be used to produce a knotted wire fence incorporating a second knot type.

Preferably the first knot type is a stay knot and the second knot type is a fixed knot.

Preferably the drive shaft driving means is configured to drive the or each drive shaft in a rotary motion. More preferably there are four drive shafts.

In a first preferred embodiment, the drive shaft driving means is a series of rotary servo motors and a controller. Preferably in switching the machine between the first configuration and the second configuration, the programme on the controller is switched between a stay knot drive programme and a fixed knot drive programme.

In a second preferred embodiment, the drive shaft driving means is a mechanical motion control consisting of a rotary gear box for converting a rotary input into the required timed motion of the drive shafts. Preferably in switching the machine between the first configuration and the second configuration, a stay knot rotary gear box is removed and replaced with a fixed knot rotary gear box.

Preferably in switching the machine between the first configuration and the second configuration, the position of the drive shafts is not changed.

In a preferred embodiment, the machine further includes a crimp drum and a stay wire projector.

In a further aspect, the present invention provides a knot box for the machine described above configured to produce a stay knotted wire fence, the knot box being configured to receive a line wire, a stay wire substantially perpendicular to the line wire, and a knot wire, and perform the actions of:

- receiving a first rotary motion and using it to move a placer arm to position the stay wire adjacent the line wire;
- receiving a second rotary motion and using it to feed the knot wire behind the intersection of the line wire and the stay wire, at an angle to both the line wire and the stay wire;
- receiving a third rotary motion and using it to twist a first end of the knot wire about the stay wire on a first side of the line wire, and to twist a second end of the knot wire about the stay wire on a second side of the line wire substantially opposite the first side.

The present invention further provides a machine for making a stay knot wire fence, including the machine described above, wherein the at least one knot box is the knot box for a stay knotted wire fence described above. Preferably the first rotary motion is provided by a second drive shaft, the second rotary motion is provided by a first drive shaft, and the third rotary motion is provided by a fourth drive shaft of the machine.

In a further aspect, the present invention provides a knot box for the machine described above configured to produce fixed knotted wire fence, the knot box being configured to receive a line wire, a stay wire substantially perpendicular to the line wire, and a knot wire, and perform the actions of:

- receiving a first rotary motion and using it to move a placer arm to position the stay wire adjacent the line wire;
- receiving a second rotary motion and using it to feed the knot wire into a position adjacent the intersection between the line wire and the stay wire, parallel to the line wire, on an opposite side of the stay wire to the line wire;

receiving a third rotary motion and using it to twist a first end of the knot wire on a first side of the stay wire under the line wire on a side of the line wire opposite the stay wire, and around the line wire in a 360° rotation, and also to twist a second end of the knot wire on a second side of the stay wire substantially opposite the first side under the line wire on a side of the line wire opposite the stay wire, and around the line wire in a 360° rotation;

receiving a fourth rotary motion in the fixed knot gear cartridge and using it to wind both the first end and the second end of the knot wire around the stay wire.

The present invention further provides a machine for making a fixed knot wire fence, including the machine described above, wherein the at least one knot box is the knot box for a fixed knotted wire fence described above. Preferably the first rotary motion is provided by a second drive shaft, the second rotary motion is provided by a first drive shaft, the third rotary motion is provided by a third drive shaft, and the fourth rotary motion is provided by a fourth drive shaft of the machine.

The present invention further provides a machine for making a knotted wire fence as described above, wherein in the first configuration, the or each knot box is the knot box for a stay knotted wire fence described above, and in the second configuration, the or each knot box is the knot box for a fixed knotted wire fence described above.

In a preferred embodiment, the four drive shafts are positioned so as to provide rotary motion to either of the knot boxes described above.

BRIEF DESCRIPTION OF THE DRAWINGS

By way of non-limiting example only, preferred embodiments of the invention are described in detail below with reference to the accompanying drawings, in which.

BEST METHOD OF PERFORMING THE INVENTION

Figure 1A:
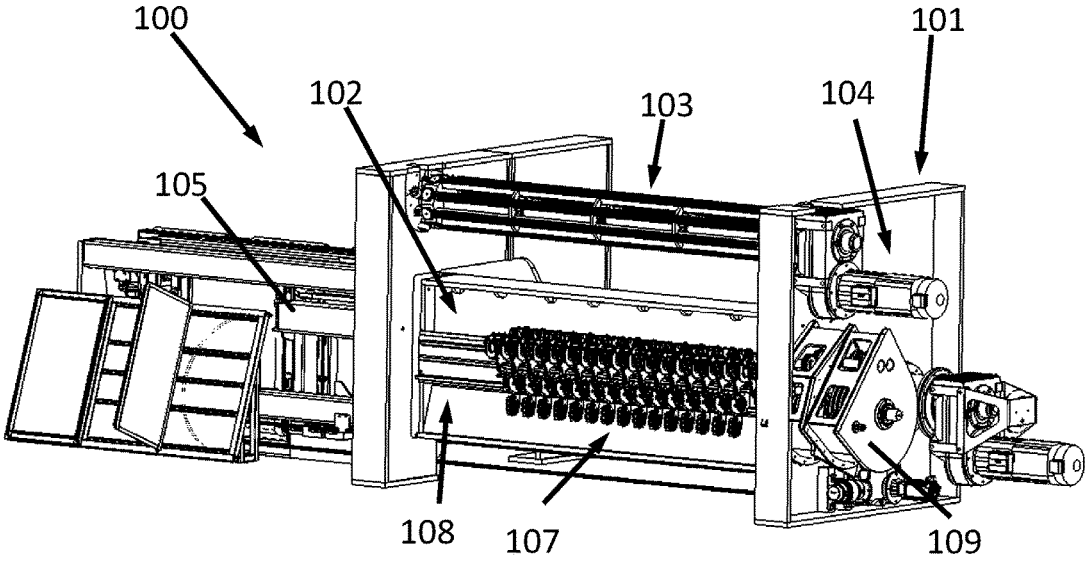
FIG. 1*a* is a front view of a machine according to the present invention.
Figure 1B:
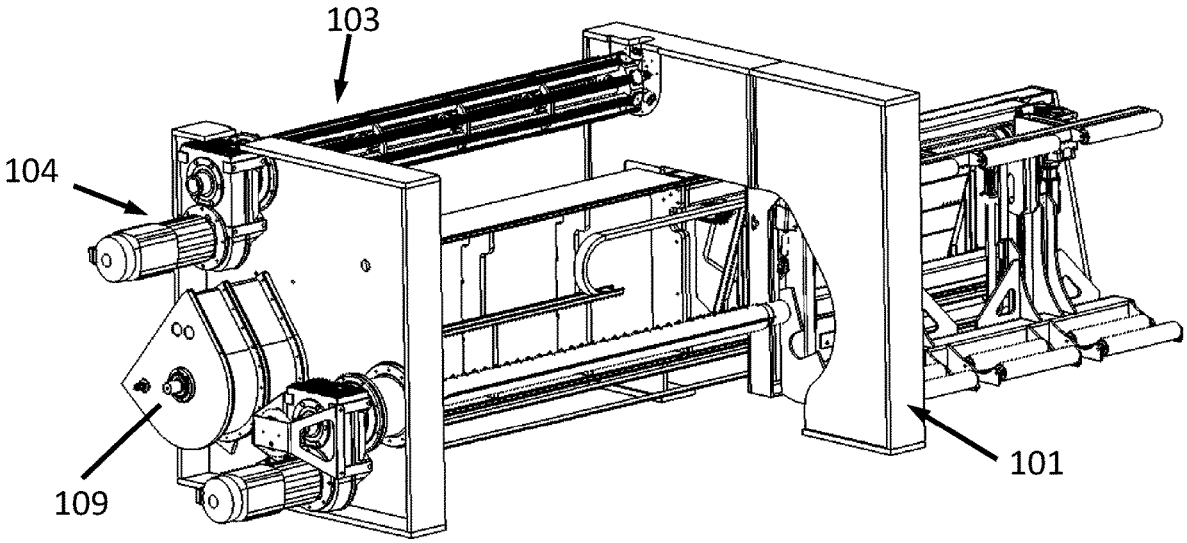
FIG. 1*b* is a back view of the machine of FIG. 1.

FIGS. 1*a* and 1*b* show a machine 100 according to the present invention, including a machine frame 101 supporting a knotting bed 102, a crimp drum 103 driven by a crimp drum drive 104, a stay wire projector 105, and a series of knot boxes 107 mounted on knot drive shafts 108 driven by a knot drive 109.

A series of parallel line wires (not shown) extends substantially vertically across the knotting bed 102 from a lower edge of the knotting bed 102 to engage with crimp drum 103. A stay wire (not shown) is projected by stay wire projector 105 in known manner substantially horizontally across the knotting bed 102, with the line wires located between the stay wire and the knotting bed 102. A knot box 107 is located over each line wire, with a knot wire (not shown) fed into each knot box 107.

In known manner, over the two outer-most line wires, instead of a knot box, a standard end twister box (not shown) is provided, to twist the ends around the outer-most line wire.

Although it is known to include a single cutter adjacent the twister box closest to the stay wire Jo projector 105 to cut the stay wire, in an optional embodiment the machine 100 of the present invention may include a cutter adjacent each of the two twister boxes, to cut the stay wire to a precise desired length.

Crimp drum 103 is driven by crimp drum drive 104, which in this preferred embodiment is a rotary servo motor. It operates in a step function to rotate crimp drum 103 extending the line wires across the knotting bed 102, halt while the knot boxes 107 are in operation to knot the stay wire to the line wires, then rotate a set distance to extend the line wires to be in position to receive the next stay wire for the desired spacing of stay wires in the finished fence.

Stay Knot—Knot Box

Figure 2:
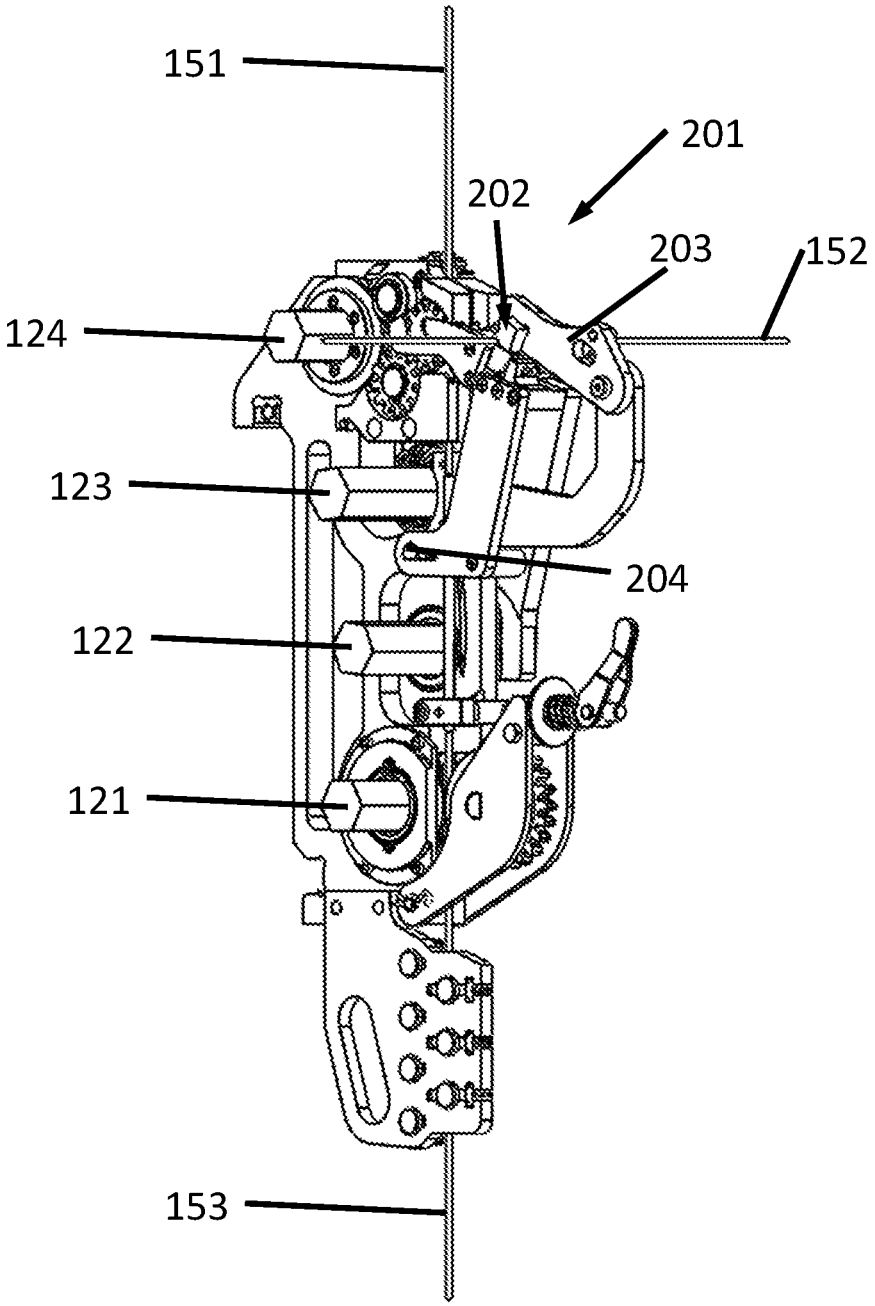
FIG. 2 is a perspective view of a stay knot box according to the present invention.
Figure 3:
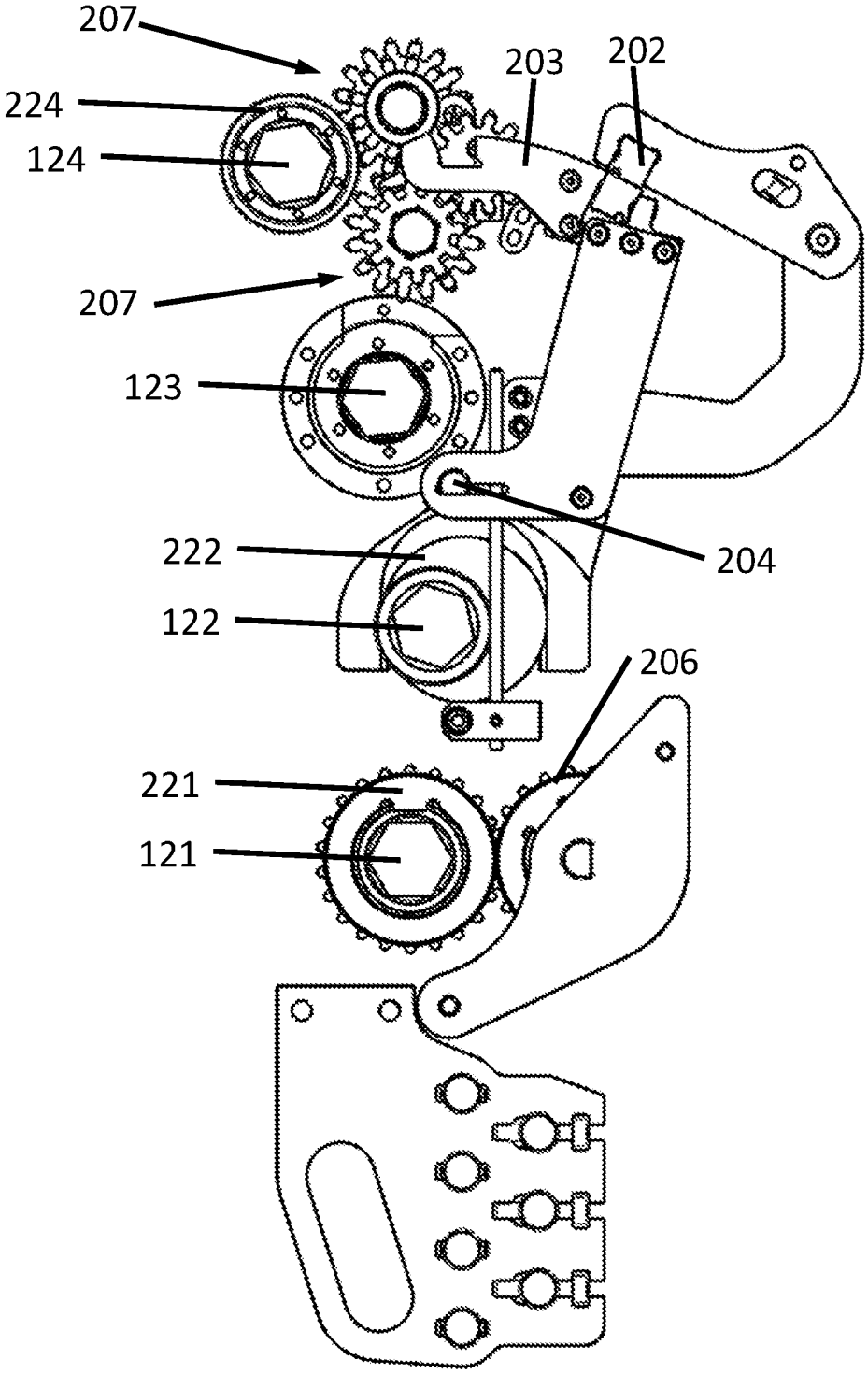
FIG. 3 is a partial cross-section of operative parts of the stay knot box of FIG. 2.

FIG. 2 shows a perspective view of a stay knot box 201 engaged with a line wire 151 and a stay wire 152, and receiving a knot wire 153. FIG. 3 shows a partial cross-section of operational parts of stay knot box 201.

Figure 4:
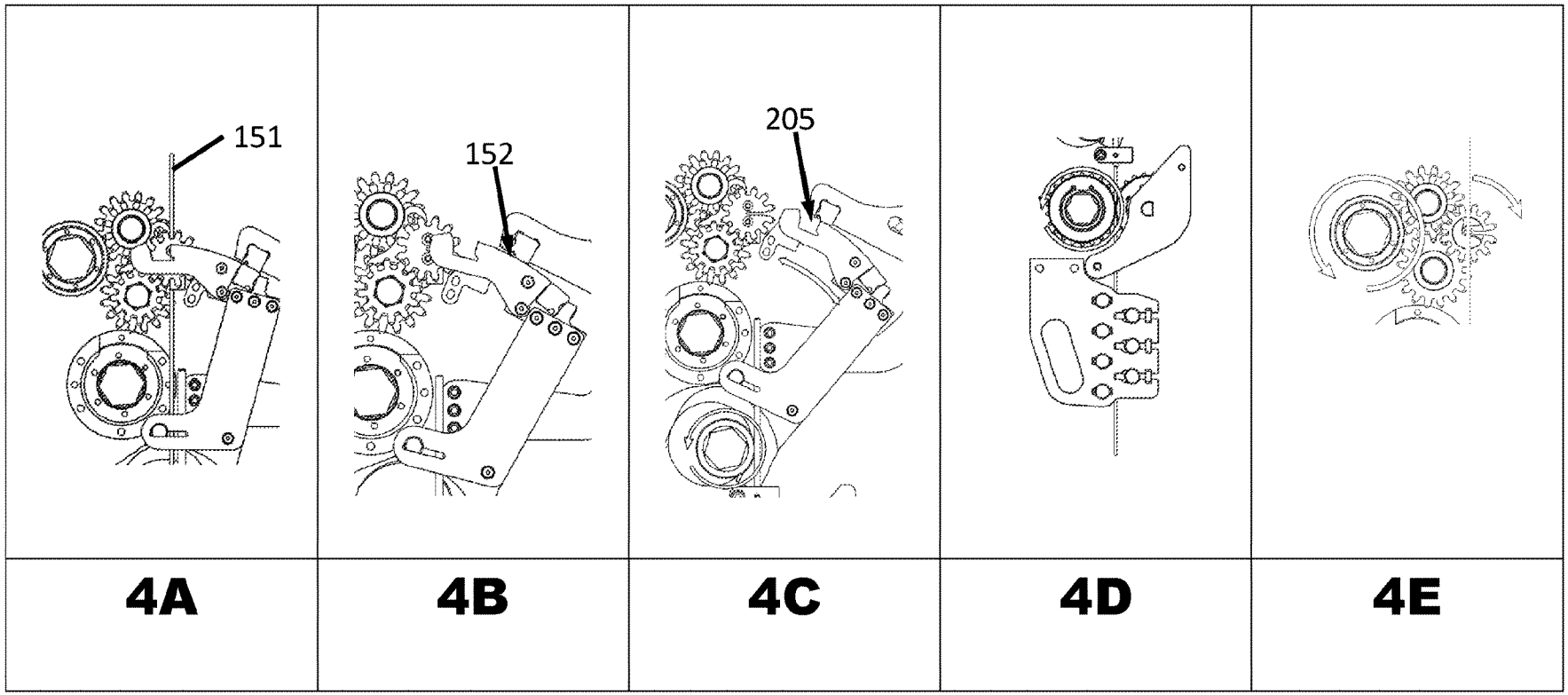
FIGS. 4*a* to 4*e* are a sequence showing the operation of the stay knot box of FIG. 2.
Figure 5:
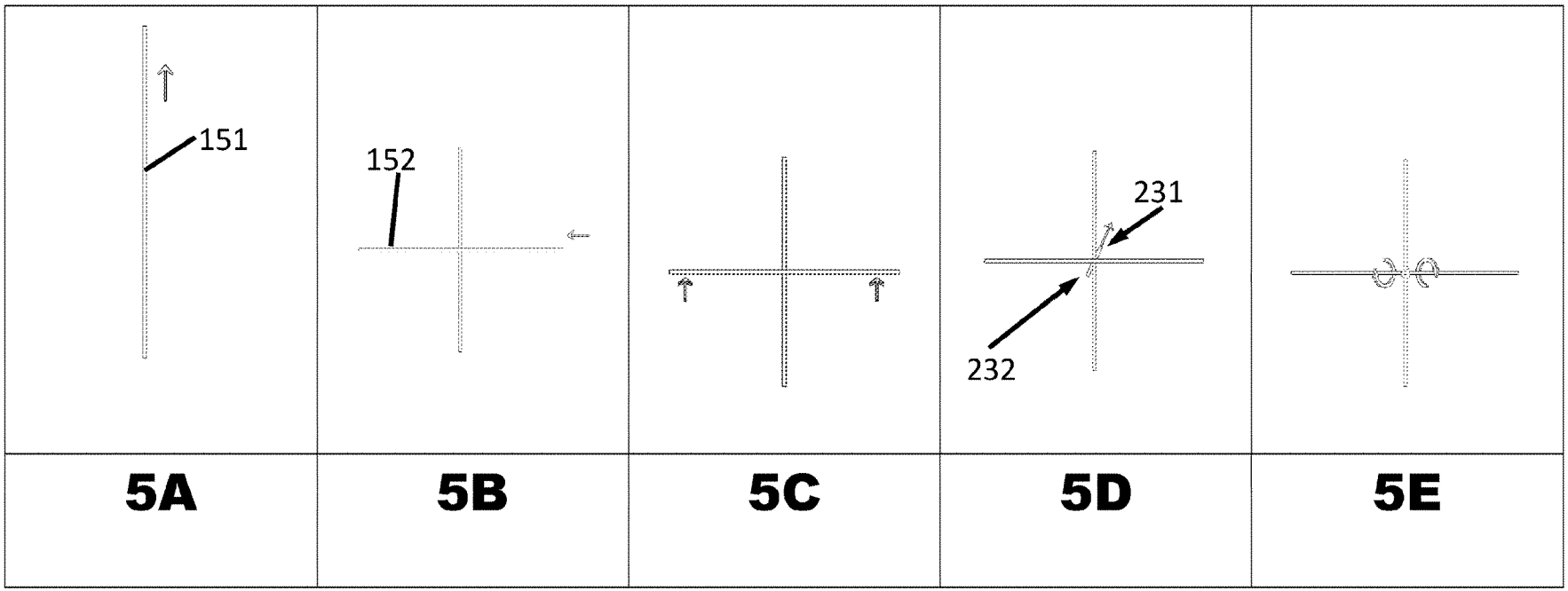
FIGS. 5*a* to 5*e* are a sequence showing the wires during each step shown in FIG. 4.

The method of operation of the machine fitted with a series of stay knot boxes 201 is described in detail with reference to FIGS. 4 and 5. The rotation of the drive shafts is described relative to the placement of the drive means on one side of the machine. It will be obvious to one skilled in the art that if the drive means are placed on the other side of the machine, all the rotations will be reversed.

At step A, line wire 151 fed through the stay knot box 201 by the drive of crimp drum 103.

At step B, stay wire 152 is projected by stay wire projector 105 across line wire 151 through a stay wire support guide 202.

At step C, second drive shaft 122 rotates in an anti-clockwise direction. Second drive shaft 122 is engaged with a second drive shaft receiver 222 in the knot box 201. Second drive shaft receiver 222 is asymmetrical, so that initial rotation of second drive shaft receiver 222 rotates placer arm 203 about placer arm pivot 204 to the position shown in FIG. 4C, so stay wire 152 engages with stay wire placer groove 205. The continuing rotation of asymmetrical second drive shaft receiver 222 then rotates placer arm 203 back to the position shown in FIG. 3, in which the stay wire 152 is now adjacent line wire 151. The second drive shaft 122 also activates a cutting blade (not part of knot box 201, and therefore not shown) to cut stay wire 152. Second drive shaft 122 stops rotating.

At step D, first drive shaft 121 rotates in an anti-clockwise direction. First drive shaft 121 is engaged with a first drive shaft receiver 221 in the knot box 201. First drive shaft receiver 221 includes gear teeth that engage with a knot wire gear 206 so that rotation of first drive shaft receiver 221 feeds knot wire 153 into position behind line wire 151 at an angle thereto. First drive shaft 121 stops rotating.

At step E, fourth drive shaft 124 rotates in a clockwise direction. Fourth drive shaft 124 is engaged with a fourth drive shaft receiver 224 in the knot box 201. Rotation of fourth drive shaft receiver 224 simultaneously drives two sets of twisting gears 207, each of which may also incorporate cams (not shown) to elongate the action so as to reduce tension on the knot wire 153 during this step E. Twisting gears on a first side of line wire 151 (shown in FIG. 4E) cut knot wire 153 to create a first end 231 of knot wire 153, and twist first end 231 clockwise about adjacent stay wire 152 on the first side of line wire 151. Twisting gears on a second side of line wire 151 twist a second end 232 of knot wire 153 anti-clockwise about adjacent stay wire 152 on the second side of line wire 151. Fourth drive shaft 124 stops rotating.

This complete the stay knot, and steps A to E can then be repeated multiple times to produce a rectangular lattice of knotted fence mesh.

Fourth drive shaft receiver 224 and its associated gears are preferably incorporated into a stay knot gear cartridge that is removable from stay knot box 201.

Fixed Knot—Knot Box

Figure 6:
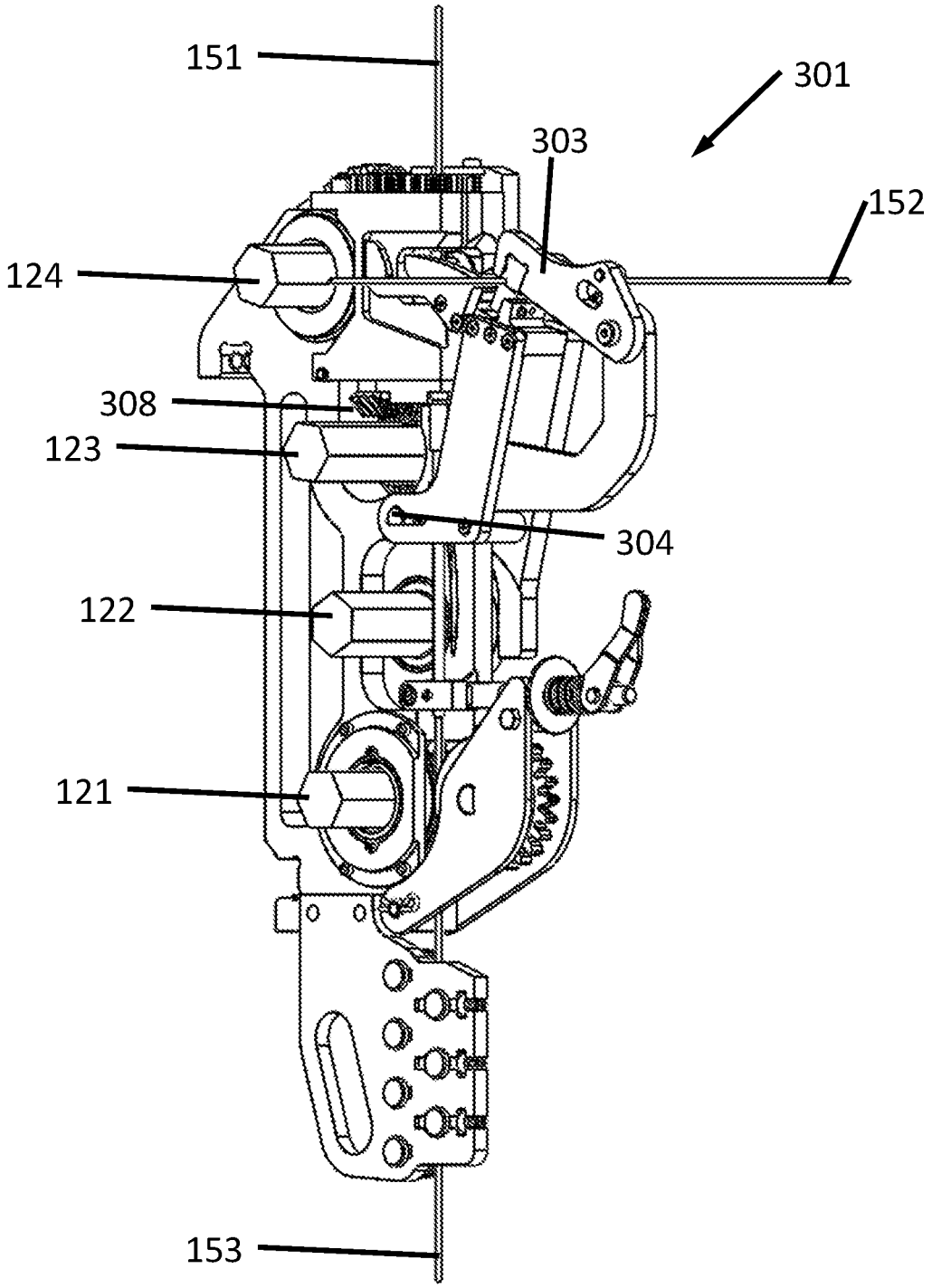
FIG. 6 is a perspective view of a fixed knot box according to the present invention.
Figure 7:
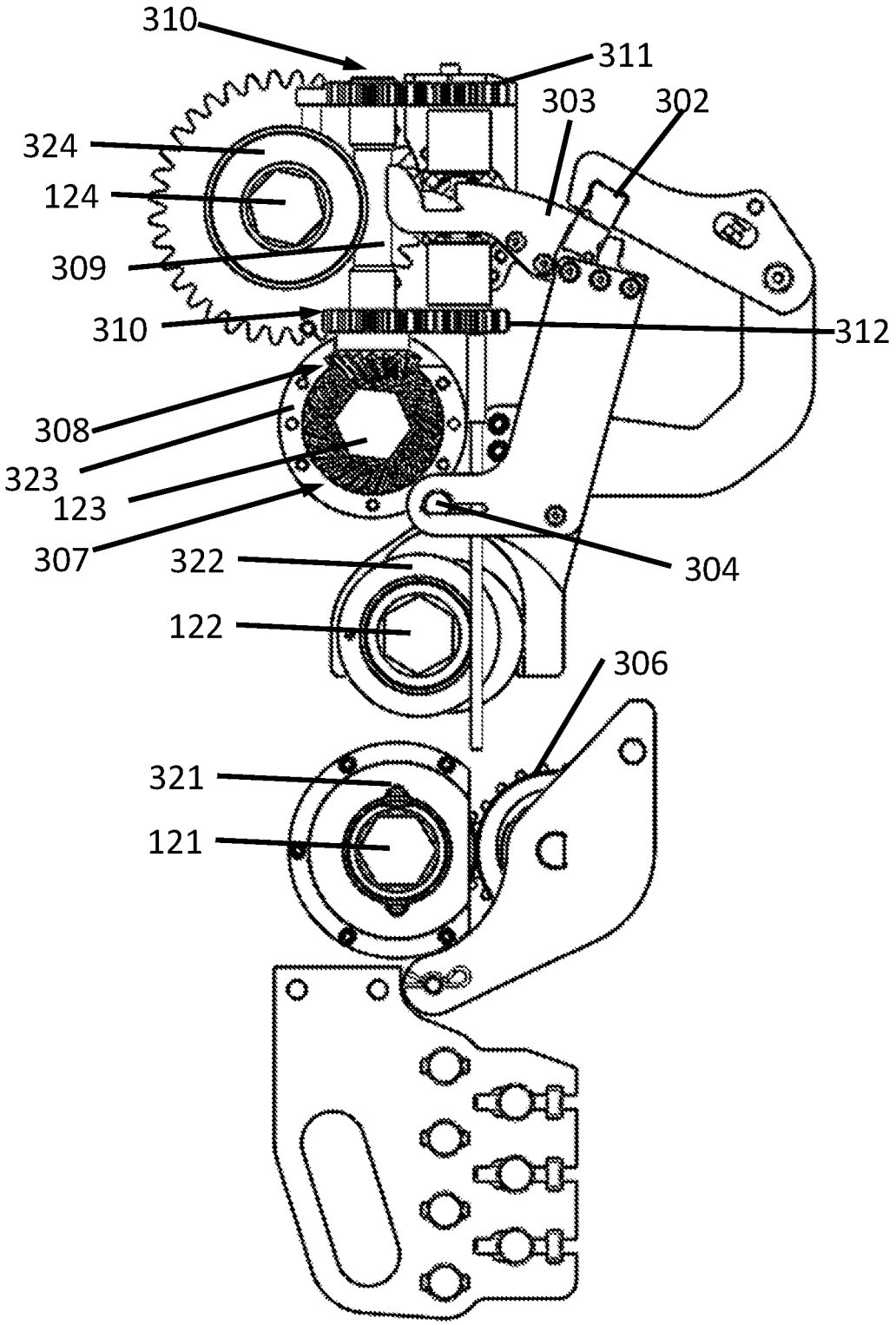
FIG. 7 is a partial cross-section of operative parts of the fixed knot box of FIG. 6.

FIG. 6 shows a perspective view of a fixed knot box 301 engaged with a line wire 151 and a stay wire 152, and receiving a knot wire 153. FIG. 7 shows a partial cross-section of operational parts of stay knot box 201.

Figure 8:
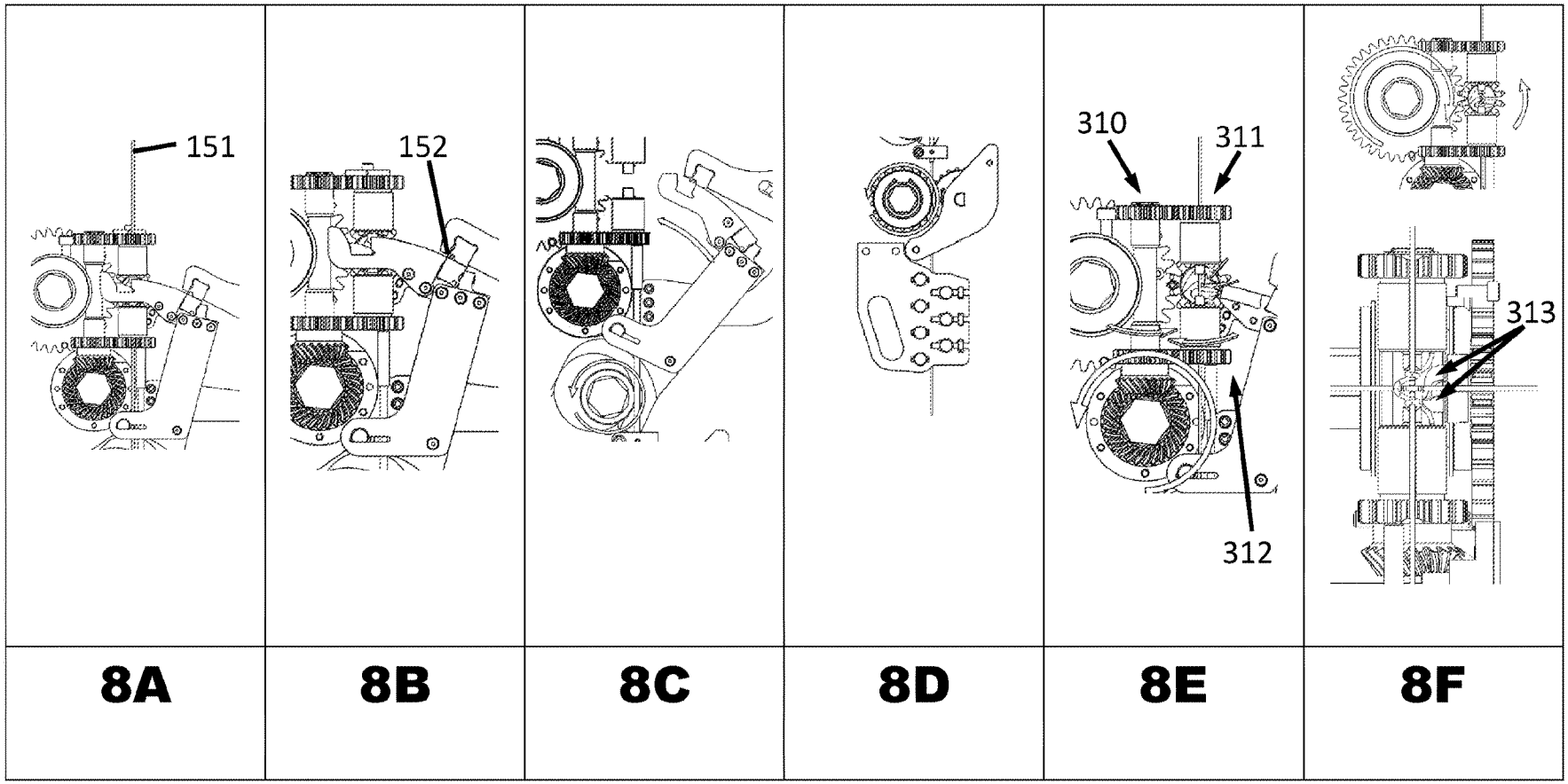
FIGS. 8*a* to 8*f* are a sequence showing the operation of the fixed knot box of FIG. 6.
Figure 9:
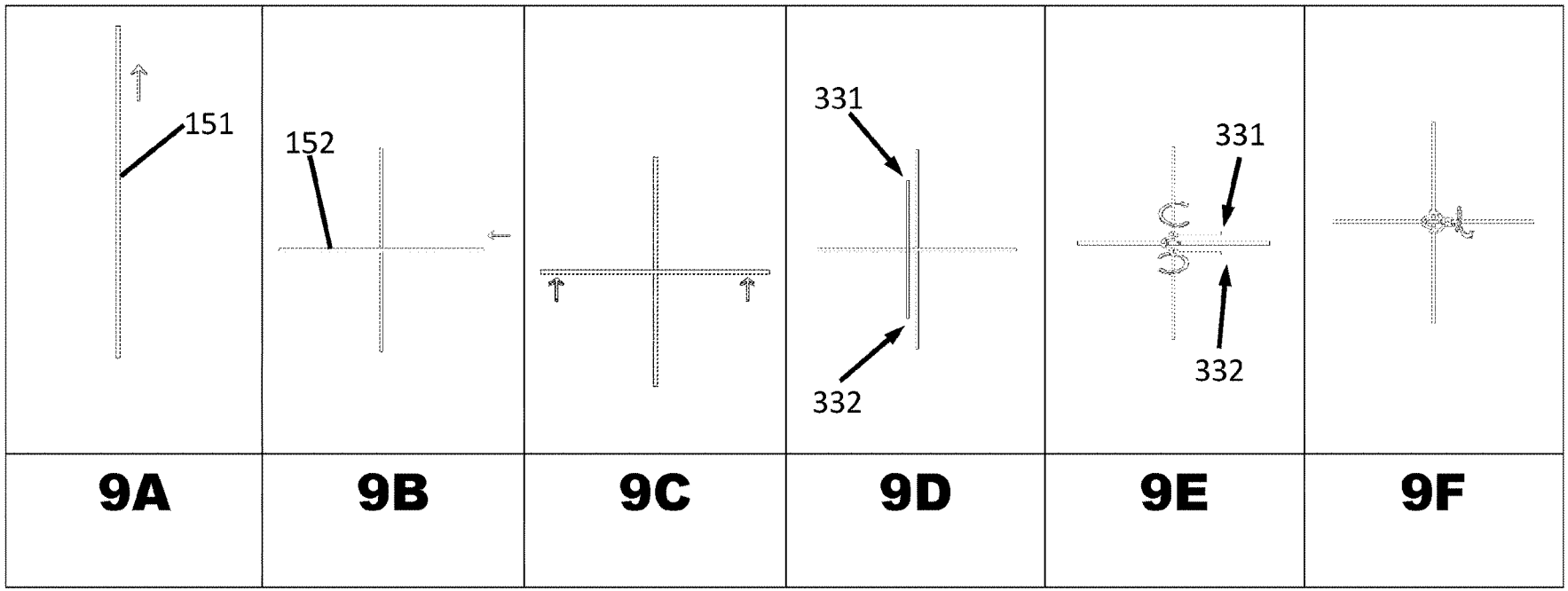
FIGS. 9*a* to 9*f* are a sequence showing the wires during each step shown in FIG. 8.

The method of operation of the machine fitted with a series of fixed knot boxes 102 is described in detail with reference to FIGS. 8 and 9. The rotation of the drive shafts is described relative to the placement of the drive means on one side of the machine. It will be obvious to one skilled in the art that if the drive means are placed on the other side of the machine, all the rotations will be reversed.

At step A, line wire 151 fed through the fixed knot box 301 by the drive of crimp drum 103.

At step B, stay wire 152 is projected by stay wire projector 105 across line wire 151 through a stay wire support guide 302.

At step C, second drive shaft 122 rotates in an anti-clockwise direction. Second drive shaft 122 is engaged with a second drive shaft receiver 322 in the knot box 301. Second drive shaft receiver 322 is asymmetrical, so that initial rotation of second drive shaft receiver 322 rotates placer arm 303 about placer arm pivot 304, until stay wire 152 engages with a stay wire placer groove. The continuing rotation of asymmetrical second drive shaft receiver 322 then rotates placer arm 303 back to the position shown in FIG. 7, in which the stay wire 152 is now adjacent line wire 151. The second drive shaft 122 also activates a cutting blade (not part of knot box 301, and therefore not shown) to cut knot wire 153. Second drive shaft 122 stops rotating.

At step D, first drive shaft 121 rotates in an anti-clockwise direction. First drive shaft 121 is engaged with a first drive shaft receiver 321 in the knot box 301. First drive shaft receiver 321 includes gear teeth that engage with a knot wire gear 306 so that rotation of first drive shaft receiver 321 feeds knot wire 153 into position parallel to line wire 151, on an opposite side of stay wire 152 to line wire 151. First drive shaft 121 stops rotating.

At step E, third drive shaft 123 rotates in an anti-clockwise direction. Third drive shaft 123 is engaged with a third drive shaft receiver 323 in the knot box 301. Third drive shaft receiver 323 is fitted with drive bevel gear teeth 307 to engage with shaft bevel gear teeth 308 to drive a twist shaft 309 connected to twist activation gears 310. Each twist activation gear is engaged with a set of twist gears. First twist gears 311 on a first side of stay wire 152 twist a first end 331 of knot wire 153 on the first side of stay wire 152 under line wire 151 on a side of line wire 151 opposite stay wire 152, then anti-clockwise around line wire 151 in a 360° rotation to the position shown in FIG. 9E. Simultaneously, second twist gears 312 on a second side of stay wire 152 perform a mirror image action to twist a second end 332 of knot wire 153 on the second side of stay wire 152 under line wire 151 on a side of line wire 151 opposite stay wire 152, then anti-clockwise around line wire 151 in a 360° rotation to the position shown in FIG. 9E. Third drive shaft 123 stops rotating.

At step F, fourth drive shaft 124 rotates in a clockwise direction. Fourth drive shaft 124 is engaged with a fourth drive shaft receiver 324 in the knot box 301. Fourth drive shaft receiver 324 includes gear teeth that engage with a tying gear 313 that engages with both first end 331 and second end 332 of knot wire 153 to wind both first end 331 and second end 332 of knot wire 153 around stay wire 152. Fourth drive shaft 124 stops rotating.

This complete the fixed knot, and steps A to F can then be repeated multiple times to produce a rectangular lattice of knotted fence mesh.

Third drive shaft receiver 323 and its associated gears, and fourth drive shaft receiver 324 and its associated gears, are preferably incorporated into a fixed knot gear cartridge that is removable from fixed knot box 301.

Electronically Controlled Drive Shaft Activation

The machine 100 of the present invention includes knot drive shafts 108. Described in detail above are the operation of knot boxes 107, by way of example being a stay knot box 201 and a fixed knot box 301. Each of stay knot box 201 and fixed knot box 301 is configured to receive first drive shaft 121, second drive shaft 122, third drive shaft 123, and fourth drive shaft 124.

In this preferred embodiment, the position of these knot drive shafts 108 in machine frame 101 is identical, whether stay knot boxes 201, or fixed knot boxes 301 are installed.

Figure 10:
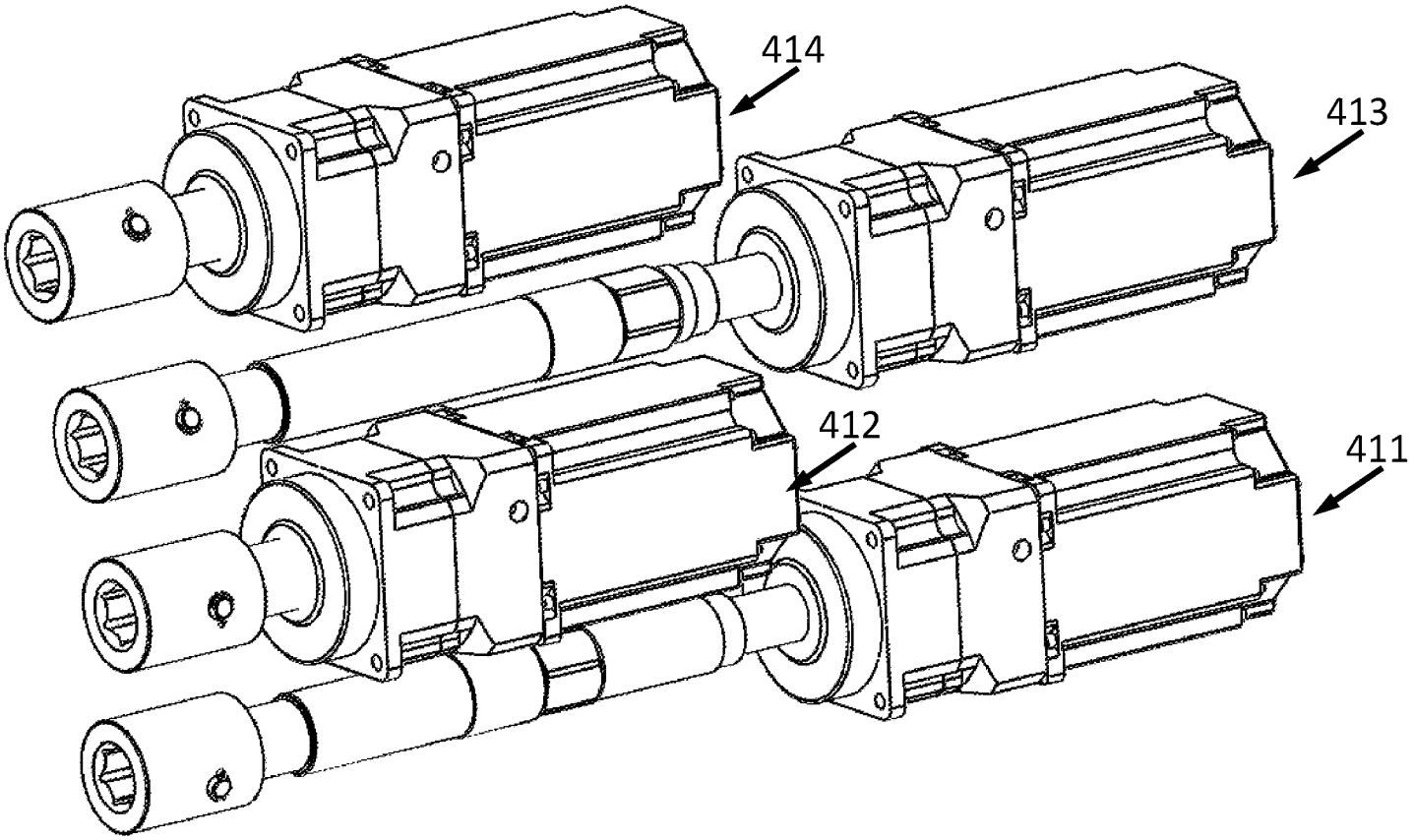
FIG. 10 is a perspective view of a servo motors to drive the machine according to the present invention.

Knot drive shafts 108 may be driven by rotational servo motors, such as those shown in FIG. 10, installed on machine frame 101. A first rotational servo motor 411 is configured to drive first drive shaft 121, a second rotational servo motor 412 is configured to drive second drive shaft 122, a third rotational servo motor 413 is configured to drive third drive shaft 123, and a fourth rotational servo motor 414 is configured to drive fourth drive shaft 124.

It will be appreciated by one skilled in the art that these servo motors can be controlled by a single controller, which can also be used to control crimp drum drive 104 and/or stay wire unit 105 to provide complete control for the machine 100.

The controller can be programmed to drive the drive shafts 108 to operate a series of stay knot boxes 201 to operate as described above in detail. The same controller can also be programmed to drive the same drive shafts 108 to operate a series of fixed knot boxes 301 as described above in detail.

In a first configuration, the machine 100 is fitted with stay knot boxes 201, and a controller configured to drive these. In a second configuration, the machine 100 is fitted with fixed knot boxes 301, and the controller is configured to drive these.

In this way, the same machine can be repurposed to produce either stay lock or fixed knot fencing, with only the knot boxes needing to be physically changed, and the controller configuration switched from one pre-loaded programme to another.

Mechanically Controlled Drive Shaft Activation

Figure 11A:
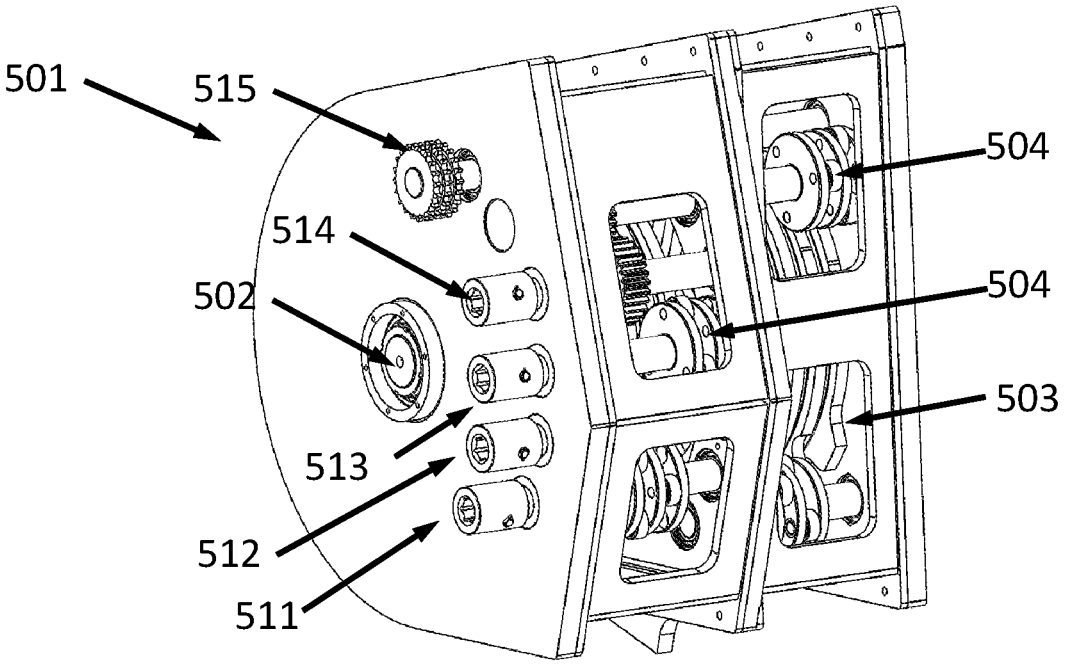
FIG. 11*a* is a first side perspective view of a mechanical gear box to drive the machine shown in FIG. 1.
Figure 11B:
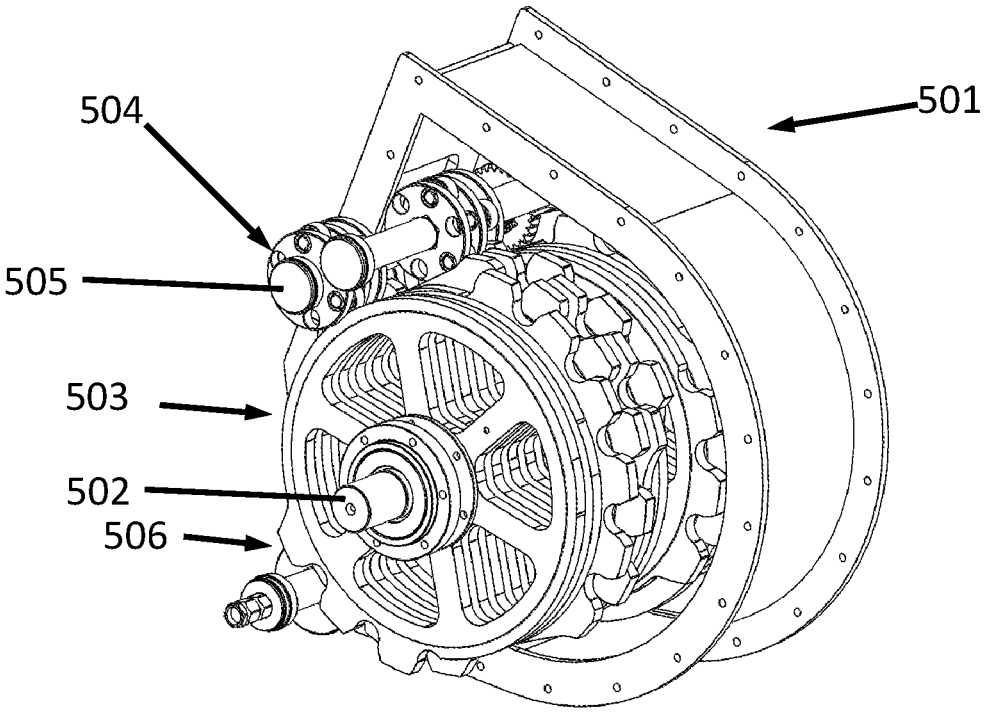
FIG. 11*b* is a second side perspective view of the gear box of FIG. 11*a;*
Figure 12A:
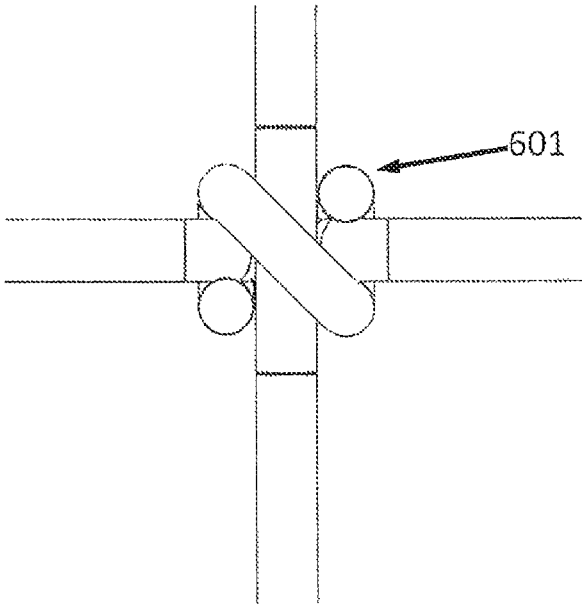
FIGURE 12a (PRIOR ART)
FIG. 12*a* is a back view of a stay knot in a fence mesh.
Figure 12B:
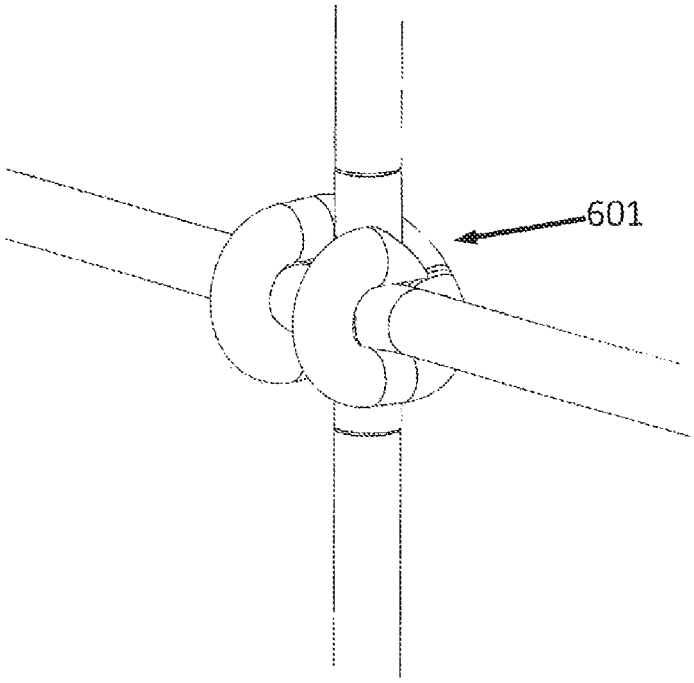
FIGURE 12b (PRIOR ART)
FIG. 12*b* is a front perspective view of a stay knot in a fence mesh.
Figure 13A:
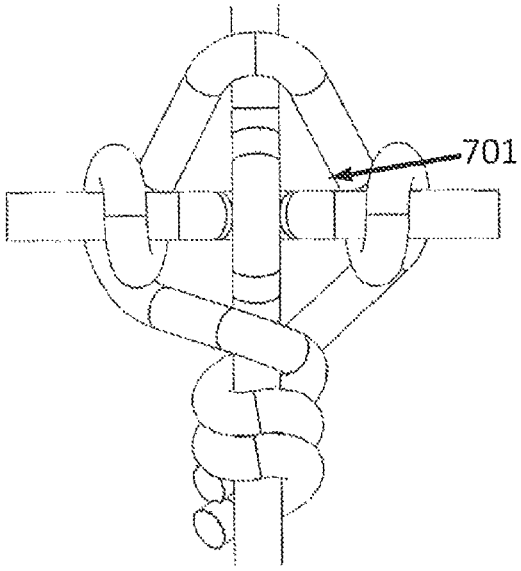
FIGURE 13a (PRIOR ART)
FIG. 13*a* is a back view of a fixed knot in a fence mesh.
Figure 13B:
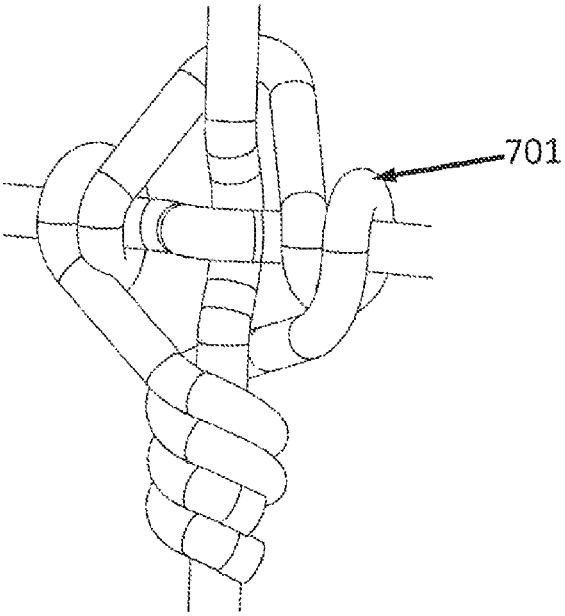
FIGURE 13b (PRIOR ART)
FIG. 13*b* is a front perspective view of a fixed knot in a fence mesh.

An alternative embodiment does not use the servo motors shown in FIG. 10, but instead a rotary gear box 501 such as that shown in FIG. 11. This may have advantages in some situations over the operation of electronic drive controllers, which may require specialist training, and be more expensive to purchase and maintain.

The primary drive shaft 502 (connectable to a standard rotary motor, which is not shown) is attached to timing gears 503. Each timing gear 503 includes a series of engagement teeth 506 for periodic engagement with rotary drive engagers 504, each of which is connected to a drive shaft 505. Rotation of primary drive shaft 502 rotates the timing gears 503. When the engagement teeth 506 of a particular timing gear 503 reach its corresponding drive engager 504, the drive engager 504 is rotated to turn its connected drive shaft 505.

As shown in FIG. 11A, the rotary gear box 501 can be configured to drive a first rotational driver 511 configured to connect to first drive shaft 121, a second rotational driver 512 configured to connect to second drive shaft 122, a third rotational driver 513 configured to connect to third drive shaft 123, and a fourth rotational driver 514 configured to connect to fourth drive shaft 124.

Different configurations of engagement teeth 506 on timing gears 503 can be used to activate the drive shafts 108 to operate either a series of stay lock knot boxes 201, or a series of fixed knot boxes 301, in the manner described in detail above.

Optionally, instead of the separate crimp drum drive 104 shown in FIG. 1, rotary gear box 501 can include a crimp drum drive gear 515, driven in the same timed manner as the rotational drivers. Crimp drum drive gear 515 which connects to crimp drum 103 to enable the rotary gear box 501 to control the timed step rotation of crimp drum 103 at step A of the knotting process. It will be apparent to one skilled in the art that at least one mechanical motion control system such as rotary gear box 501 can be used to operate any number of components of the machine, and that one or more mechanical or electronically controlled systems, or any combination thereof, can be used.

Machine 100 can be provided with multiple different rotary gear boxes 501. In order to change machine 100 from a first configuration adapted to produce stay lock fencing, to a second configuration adapted to produce fixed knot fencing at least the knot boxes 107 can be removed and replaced. However, advantageously the drive shafts remain in the same places. To improve performance, rotary gear box 501 may also be replaced for the different configurations.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

This invention may also be said broadly to consist in the parts, elements and features referred to or indicated in the specification of the application, individually or collectively, and any or all combinations of any two or more of said parts, elements and features, and where specific integers are mentioned herein which have known equivalents in the art to which this invention relates, such known equivalents are deemed to be incorporated herein as if individually set forth.

The invention claimed is:

1. A machine for making a knotted wire fence incorporation either a first knot type or a second knot type, said machine comprising:

a machine frame including a knotting bed for supporting a series of spaced parallel wires;

a plurality of driveshafts each of which extends across said knotting bed;

each driveshaft having at least one knot box mounted thereon;

a driveshaft driving means driveably connected to said driveshafts;

wherein said machine is switchable between:

a first configuration in which each of said knot boxes is configured to produce said first knot type and in use the machine produces a knotted wire fence incorporation said first knot type;

and a second configuration in which each of said knot boxes is configured to produce said second knot type and in use the machine produces a knotted wire fence incorporation said second knot type;

said second knot type being different from said first knot type.

2. The machine according to claim 1, wherein the first knot type is a stay knot and the second knot type is a fixed knot.

3. The machine according to claim 2, wherein the drive shaft driving means is configured to drive each of said plurality of drive shaft in a rotary motion.

4. The machine according to claim 1, wherein the drive shaft driving means is configured to drive the or each drive shaft in a rotary motion.

5. The machine according to claim 4, wherein said plurality of drive shafts comprises four drive shafts.

6. The machine according to claim 5, wherein the drive shaft driving means is a series of rotary servo motors and a controller, and wherein in switching the machine between the first configuration and the second configuration, the controlled is controlled by a programme which is switched between a first knot drive programme and a second knot drive programme.

7. The machine according to claim 6, wherein in switching the machine between the first configuration and the second configuration, the position of the drive shafts is not changed.

8. The machine according to claim 5, wherein the drive shaft driving means is a mechanical motion control consisting of a rotary gear box for converting a rotary input into the required timed motion of the drive shafts, and wherein in switching the machine between the first configuration and the second configuration, said at least one knot box, in the form of a first knot rotary gear box is removed and replaced with a second knot rotary gear box.

9. The machine according to claim 8, wherein in switching the machine between the first configuration and the second configuration, the position of the drive shafts is not changed.

10. The machine according to claim 4, wherein the drive shaft driving means is a series of rotary servo motors and a controller, and wherein in switching the machine between the first configuration and the second configuration, the programme on the controller is switched between a first knot drive programme and a second knot drive programme.

11. The machine according to claim 10, wherein in switching the machine between the first configuration and the second configuration, the position of the drive shafts is not changed.

12. The machine according to claim 4, wherein the drive shaft driving means is a mechanical motion control consisting of a rotary gear box for converting a rotary input into the required timed motion of each of said the drive shafts, and wherein in switching the machine between the first configuration and the second configuration, said at least one knot box is a first knot rotary gear box, whichh is removed and replaced with a knot box which is a second knot rotary gear box.

13. The machine according to claim 12, wherein in switching the machine between the first configuration and the second configuration, the position of the drive shafts is not changed.

14. The machine according to claim 1, wherein in switching the machine between the first configuration and the second configuration, the position of the drive shafts is not changed.

15. The machine according to claim 1, wherein in the first configuration said at least one knox is a first knot box configured to produce a stay knotted wire fence, and wherein in the second configuration said at least one knot box is a second knot box configured to produce a fixed knotted wire fence.

* * * * *